US007252430B2

(12) United States Patent
Terzian et al.

(10) Patent No.: US 7,252,430 B2
(45) Date of Patent: Aug. 7, 2007

(54) ERGONOMIC WATCH CASE, TIME DISPLAY AND SETTING CROWN

(75) Inventors: Berj A. Terzian, Newbury, MA (US); Robert Alfred Brodman, Weehawken, NJ (US)

(73) Assignee: Equitime, Inc., Newbury, MA (US)

( * ) Notice: Subject to any disclaimer, the term of this patent is extended or adjusted under 35 U.S.C. 154(b) by 115 days.

(21) Appl. No.: 10/756,485

(22) Filed: Jan. 12, 2004

(65) Prior Publication Data

US 2005/0152226 A1 Jul. 14, 2005

(51) Int. Cl.
*G04B 37/00* (2006.01)

(52) U.S. Cl. ..... 368/282; D10/32

(58) Field of Classification Search ..... 368/281, 368/276, 272, 292, 283, 278, 285; D10/30, D10/31, 32, 38, 21, 20
See application file for complete search history.

(56) References Cited

U.S. PATENT DOCUMENTS 2,482,660 A * 9/1949 Dewey ..... 224/179
2,840,286 A * 6/1958 Schermerhorn ..... 224/172
4,443,114 A * 4/1984 Kumata ..... 368/73
D297,418 S * 8/1988 Thalgott ..... D10/39
D330,166 S * 10/1992 Park ..... D10/32
D386,429 S * 11/1997 Brodmann ..... D10/39
D394,395 S * 5/1998 Bruce et al. ..... D10/30
D396,193 S * 7/1998 Pail ..... D10/30
6,418,085 B2 * 7/2002 Terzian ..... 368/82
D515,945 S * 2/2006 Goto et al. ..... D10/32

* cited by examiner

*Primary Examiner*—Ren Yan
(74) *Attorney, Agent, or Firm*—Lucas & Mercanti, LLP

(57) ABSTRACT

An ergonomic watch case, time display and setting crown are provided, with the case shaped generally in the form of an obtuse triangle and attached to a watch strap. A horizontal bisector through the case and time display is offset by a predetermined angle out of perpendicularity with a vertical bisector through the watch strap to improve alignment with a viewer's line of sight when reading the time. An apical setting crown is located at the apex of one of the two acute angles of the case to improve rotation of a crown knob in either direction with minimal resistance or obstruction from the watch case. A chime melody and icon are provided to sound a pleasing wake up call or other time set to be heard.

6 Claims, 1 Drawing Sheet

ERGONOMIC WATCH CASE, TIME DISPLAY AND SETTING CROWN

BACKGROUND OF THE INVENTION

1. Field of the Invention

This invention relates to wrist watches and, more particularly, to the introduction of ergonomic elements in watch cases, time displays and setting crowns which provide advantages in the viewing of time and the operation of watches containing such elements.

2. Description of the Prior Art

Conventional digital wrist watches generally display time by a horizontal array of hours, minutes and seconds reading the watch face from left to right in that order. This array is normally disposed perpendicularly to the vertical bisector of the watch face.

Other time displays characterized as quadribalanced, balanced, enhanced quadribalanced, and unidirectional segmented are disclosed in several patents, for example, U.S. Pat. No. 4,271,497, U.S. Pat. No. 4,627,737, U.S. Pat. No. 6,215,736 and U.S. Pat. No. 6,584,041, the disclosures of which are incorporated herein by reference. In these displays, during the first half of each hour, the existing hour is flanked on its right side by increasing elapsed minutes in a single or dual quarterly up/down position. After completion of the first half hour, the display transitions by increasing the hour by one to the forthcoming next hour, and minutes switch to the left side of that hour in a single or quarterly dual down/up position to count down the remaining minutes before the next hour commences. These displays also are located such that their horizontal and vertical bisectors are substantially perpendicular to each other.

3. Recognition of Drawbacks in the Prior Art

The geometries inherent in the above-discussed watch displays are less than ergonomically optimal, due to the difference in angles between the horizontal axis of the time displays and the viewer's arm position and line of sight when reading the time. For example, when a viewer, standing with a watch on the left wrist, raises his or her arm to read the time, the angle of the horizontal axis or bisector of the watch face may be approximately 60° to 70° displaced from parallel to the viewer's face and line of sight across the eyes. In order to align the horizontal bisector of the watch parallel to the line of sight, considerable rotation of the viewer's shoulder and elbow is required to decrease the 60° to 70° angle difference between these two linear projections.

Also, prior art watches that are operated with a setting crown normally position the crown on the right side of the watch case for right handed users. The knob of the setting crown requires sufficient axial thickness to enable the viewer's fingers to rotate the knob in forward or reverse directions without resistance or obstruction from the side of the watch case.

SUMMARY OF THE INVENTION

The present invention provides effective remedies for the above-discussed drawbacks by introducing new geometries for wrist watch cases and time displays, plus a relocated optimal position for a setting crown enabled by such geometries. In particular, the invention is based on forming watch cases generally in the shape of an obtuse triangle and offsetting the horizontal axis or bisector of the time display in the watch face, by a controlled extent, from perpendicular to the vertical bisector of the case, display and watch strap. As a result, the angle between the horizontal bisector of the time display and the viewer's line of sight is automatically reduced when the arm is raised in the usual position to read the time.

In addition, the triangular shape of the watch case enables locating a setting crown in an apical position at an upper apex of the case, which permits minimizing the axial thickness of the crown knob due to more free space provided by such geometry to the user's fingers, especially when the knob is in a rest position within or adjacent such apex. These advantages also assist stylists to design new and more imaginative watch appearances based upon the innovative geometries provided by the present invention.

Still another innovation is use of a three-note chime melody and icon which provide a more pleasing and acceptable wake up call or other time that the user wishes to hear.

Other features and advantages of the invention will be understood by reference to the following description of a preferred embodiment thereof, as illustrated in the drawings.

DETAILED DESCRIPTION OF THE INVENTION

Figure 1:
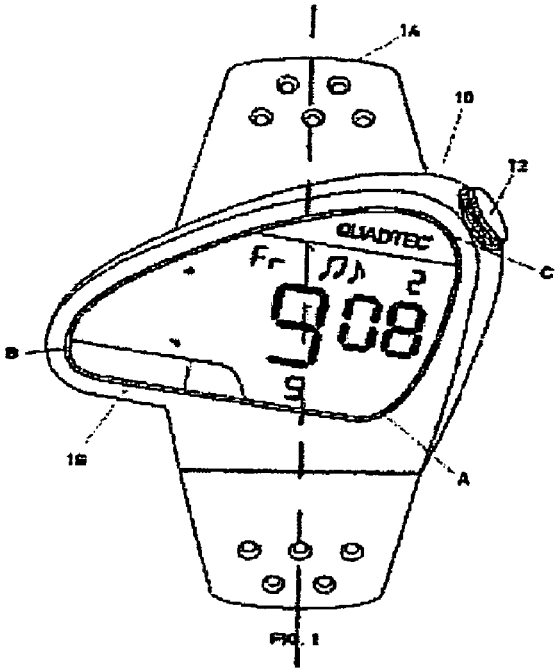
FIG. 1 is a top plan view of an ergonomic watch case and time display, with a watch strap and an apical setting crown showing a representative first quarter hour time display of 8 minutes and 5 seconds past hour 9, in accordance with U.S. Pat. Nos. 6,215,736 or 6,584,041.

Referring to FIG. 1, a watch case 10 is there illustrated formed in a generally obtuse triangular shape, with the obtuse angle at apex A and acute angles at apices B and C. In this specific embodiment, such angles are approximately 100° for A, 30° for B and 50° for C. A single setting crown 12 is located adjacent case 10 at apex C. The case 10 is connected to watch strap 14.

A horizontal bisector through the display of hour 9 and 8 minutes is generally parallel to the bottom 16 of the inner perimeter of case 10 surrounding the time display field within the watch face. This bisector divides the time display field within the case generally in half. The watch strap 14 also has a vertical bisector that divides it generally in half.

The bottom perimeter 16 and the horizontal bisector of the time display are displaced clockwise by approximately 7° out of perpendicularity with the vertical bisector of the watch strap. As a result, when a viewer's arm is raised to an angle displaced from his or her body by approximately 60° to 70° to read the time, the horizontal axis or bisector of the time display is located much closer to parallel with the line of sight across the viewer's eyes than if the horizontal bisector and display were perpendicular to the vertical bisector of the watch strap. Thus, reading and viewing the time is facilitated.

The setting crown 12, being located at the upper acute angle C, is surrounded by more free space than if it were positioned in the right side of the case between apices A and C. Therefore, a crown knob of relatively lesser axial thickness can be readily rotated in either direction by the viewer's fingers with minimal or no resistance or obstruction that would be encountered for a knob of equal thickness positioned between A and C in a straight sided case. This is another important improvement provided by the case geometry.

It will be noted that the top portion of the watch face can be provided with a three-note chime melody icon 17. The purpose of this is to confirm to the viewer that the watch has been programmed to sound a corresponding chime melody when the time set to trigger it is reached.

Preferably the melody comprises a set of three eighth notes, repeated with a pause of one eighth note duration between each set. Still more preferably, the notes are the first and third tones of a major musical scale, followed by the second tone of the same scale, for example, the middle C major scale. Thus, the first two notes preferably rise by an interval of one third, followed by a diminution to the next lower tone, i.e. do-mi-re. This provides an audio message that a wake up call or other set time has arrived, as the melody rises initially with the first two tones of the scale's dominant major chord, followed by the third subdominant tone, the latter giving an unresolved impression to remind the listener that the time has arrived for the day or an activity to begin. The overall result is a more pleasing and acceptable message when the chime melody is heard.

Figure 2:
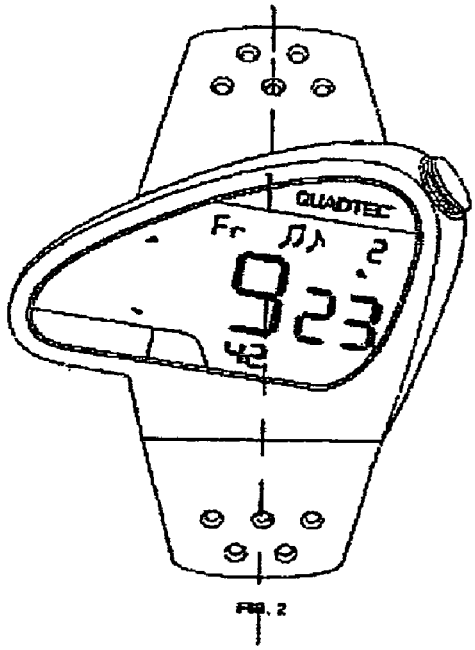
FIG. 2 is similar to FIG. 1 and shows a representative second quarter hour time display of 23 minutes and 42 seconds past hour 9.
Figure 3:
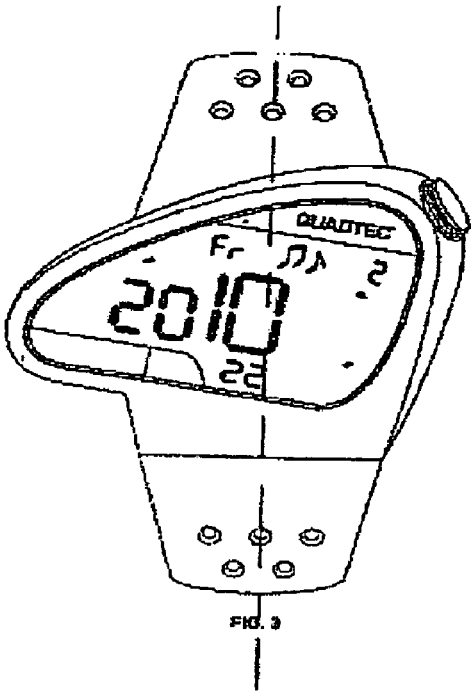
FIG. 3 is similar to FIG. 1 and shows a representative third quarter hour time display of 22 seconds and 20 minutes before hour 10.
Figure 4:
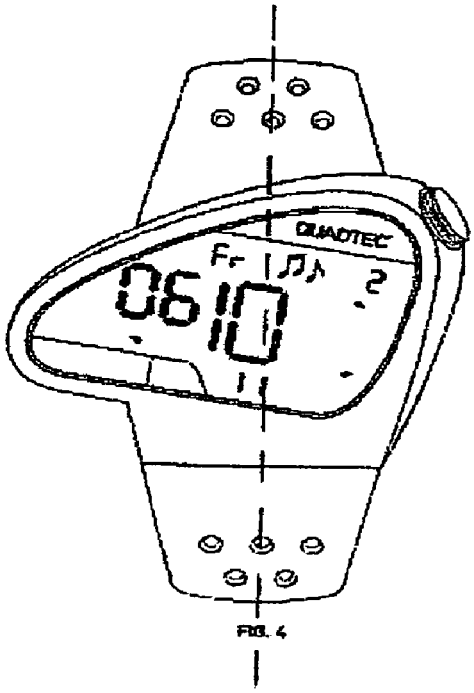
FIG. 4 is similar to FIG. 1 and shows a representative fourth quarter hour time display of 11 seconds and 6 minutes before hour ten.

FIGS. 2, 3 and 4 are constructionally the same as FIG. 1 and are included to illustrate all of the advantages of the invention throughout every hour of time displayed in cases manufactured as described herein. These figures are based on a watch case which has three dimensional thickness, the details of which are not part of the present invention.

The invention has been described in terms of its general principles and a specific embodiment. Many variations and modifications of such embodiment will be obvious to those skilled in the art. The invention may be practiced with conventional digital and analog time displays, as well as other forms such as shown and taught in the above cited prior art patents. It should be understood that the following claims are intended to cover all variations and modifications of the illustrative specific embodiment which fall within the literal scope of the claims and all equivalents thereof.

What is claimed:

1. An ergonomic object comprising a wrist watch case and a time display field surrounded by the case, both the case and the field being shaped generally in the form of an obtuse triangle including one obtuse angle and two unequal acute angles, said case being attached to watch straps at locations on opposite sides of said case which are aligned with each other so that a common vertical bisector of the straps extends through both the lengths thereof, said case and field and a horizontal bisector thereof being positioned by a predetermined angle out of perpendicularity with the vertical bisector through the watch straps, the horizontal and vertical bisectors of the display field each dividing the field into asymmetric sections, whereby when worn on a user's wrist said horizontal bisector and horizontal asymmetry are oriented closer to parallel alignment with the user's horizontal line of sight to facilitate reading time displayed within the case.

2. An object according to claim 1 wherein the larger of the two acute angles is located above the obtuse angle on the right side of the case, and the smaller of the two acute angles is located on the left side of the case.

3. An object according to claim 2 wherein the obtuse angle is approximately 100°, the larger of the two acute angles is approximately 50° and the other acute angle is approximately 30°.

4. An object according to claim 3 wherein the horizontal, bisector through the time display and the watch case is displaced at angle of approximately 7° out of perpendicularity with the vertical bisector of the watch straps.

5. An object according to claim 4 which includes a time display that is balanced, quadribalanced, enhanced quadribalanced, or unidirectional segmented.

6. An object according to claims 2 or 3 wherein a setting crown is included at approximately the convex apex of the one acute angle located above the obtuse angle.

* * * * *